US011771626B2

(12) United States Patent
Cohen

(10) Patent No.: US 11,771,626 B2
(45) Date of Patent: Oct. 3, 2023

(54) DIVERTING JEJUNOSTOMY TUBE

(71) Applicant: GEORGETOWN UNIVERSITY, Washington, DC (US)

(72) Inventor: Emil Cohen, Arlington, VA (US)

(73) Assignee: GEORGETOWN UNIVERSITY, Washington, DC (US)

( * ) Notice: Subject to any disclaimer, the term of this patent is extended or adjusted under 35 U.S.C. 154(b) by 0 days.

(21) Appl. No.: 17/044,490

(22) PCT Filed: Mar. 29, 2019

(86) PCT No.: PCT/US2019/024784
§ 371 (c)(1),
(2) Date: Oct. 1, 2020

(87) PCT Pub. No.: WO2019/195093
PCT Pub. Date: Oct. 10, 2019

(65) Prior Publication Data

US 2021/0038479 A1 Feb. 11, 2021

Related U.S. Application Data

(60) Provisional application No. 62/651,399, filed on Apr. 2, 2018.

(51) Int. Cl.
*A61J 15/00* (2006.01)

(52) U.S. Cl.
CPC ..... *A61J 15/0069* (2013.01); *A61J 15/0049* (2013.01); *A61J 15/0019* (2013.01)

(58) Field of Classification Search
CPC ..... A61J 15/0015; A61J 15/0026; A61J 15/0073; A61J 15/0069; A61J 15/0049; A61J 15/0019; A61M 25/0028; A61M 2025/0034; A61M 25/0029
See application file for complete search history.

(56) References Cited

U.S. PATENT DOCUMENTS 4,356,824 A 11/1982 Vazquez
4,642,092 A * 2/1987 Moss ..... A61J 15/0015 604/43

(Continued)

FOREIGN PATENT DOCUMENTS

JP 2012-005537 A 1/2012

OTHER PUBLICATIONS

International Search Report and Written Opinion for PCT International Patent Application No. PCT/US2019/027784, dated Jun. 14, 2019.

*Primary Examiner* — James D Ponton
*Assistant Examiner* — Neeraja Gollamudi
(74) *Attorney, Agent, or Firm* — LATHROP GPM LLP; Judith L. Stone-Hulslander

(57) ABSTRACT

An enteral feeding device permitting diversion of gastrointestinal fluid from an afferent limb to an efferent limb of gastrointestinal tract in a subject is provided. The device can be used to reduce leakage from around device and thus reduce morbidity associated with such leakage. In certain embodiments the enteral feeding device is a jejunostomy tube (J-tube). Also provided are methods for positioning and using the enteral feeding device. Also provided are kits for positioning and using the enteral feeding device.

20 Claims, 8 Drawing Sheets

(56) References Cited

U.S. PATENT DOCUMENTS

| | | | | |
|---|---|---|---|---|
| 5,098,378 | A * | 3/1992 | Piontek | A61J 15/0015 604/500 |
| 6,022,336 | A * | 2/2000 | Zadno-Azizi | A61B 17/22 604/101.05 |
| 2003/0225369 | A1 | 12/2003 | McMichael et al. | |
| 2007/0287967 | A1* | 12/2007 | Hekmat | A61M 25/008 604/284 |
| 2010/0106131 | A1 | 4/2010 | Klein et al. | |
| 2011/0098660 | A1 | 4/2011 | Porreca, Jr. | |

* cited by examiner

DIVERTING JEJUNOSTOMY TUBE

RELATED APPLICATIONS

This application is a 35 U.S.C. § 371 filing of International Patent Application No. PCT/US2019/024784, filed Mar. 29, 2019, which claims benefit of priority to U.S. Provisional Patent Application No. 62/651,399, filed Apr. 2, 2018, the entire contents of which are incorporated herein by reference.

BACKGROUND

Many people who are too ill to have oral feedings, for example, who are unable to eat, swallow food, water, or medication, and the like (such as from cancer, neurological disorders, etc.) are typically fed through enteral feeding tubes. Enteral feeding tubes permit nutrients, fluids, and other materials including medicines to be delivered directly into the gastrointestinal tract, i.e., directly into the stomach or small bowel. Depending on their site of insertion or location, such enteral feeding tubes can be nasogastric tubes (NG-tubes), gastrostomy tubes (G-tubes), or jejunostomy tubes (J-tubes). Such tubes work well, but each has its disadvantages.

In a gastrostomy tube, a feeding tract (or stoma) is created between the stomach and anterior upper abdominal wall. Feeding is performed generally by administering food through an indwelling catheter which traverses the stoma to extend at its distal end into the stomach. The proximal end remains outside of the body and is accessible for use to feed a patient directly into stomach.

Jejunostomy tubes differ from G-tubes in that they are typically introduced into an upper section of the small intestine (e.g., jejunum) distal to the stomach. J-tubes are used when there is a need or desire to bypass the stomach and to feed a patient directly into the intestinal tract. Such patients are generally fed by connecting the J-tube to an enteral feeding pump in order to deliver a "meal."

A common problem encountered with J-tubes is leakage of gastrointestinal fluid around the J-tube at the stoma, and such leakage is a frequent cause of morbidity and recurrent hospital admissions. Up to 60 percent of patients report having leakage around the tube site, and 45 percent report having stomal infections. Crosby et al. (2005) *Dig Dis Sci* 50: 1712-7. Current treatment options include enlarging the tube to seal the leak, replacing the tube with longer tubes allowing feedings to enter the gastrointestinal tract further downstream, removing the tube and permitting the tract to close down around a wire and then starting again at the same site with a smaller tube, and placing a new J-tube. Each option has risks and is rarely effective in the long term. Therefore, a need exists for a way to reduce leakage around the exiting J-tube and related morbidity and recurrent hospitalizations.

SUMMARY

It has now been noted by the inventor that most of the fluid leaking around a J-tube is bilious, indicating that leakage fluid originates from a site in the gastrointestinal tract that is upstream of (proximal to) the insertion site of the J-tube. J-tubes typically have a retention balloon inflated within the lumen of the bowel; this balloon, when inflated (as it normally is) during use of the J-tube, can cause partial obstruction of gastrointestinal contents (fluid) as it attempts to flow by normal peristalsis past the balloon from upstream.

The fluid follows a path of least resistance, which may include leakage around the J-tube where it traverses the stoma, i.e., at the J-tube exit site. This is a frequent source of problem for patients with J-tubes which leads not only to frequent dressing changes but also to skin irritation and infection.

Enteral feeding devices of the instant disclosure solve this problem by providing an alternative pathway for fluid seeking to flow past the J-tube. The alternative pathway permits fluid from upstream to flow from an afferent limb to an efferent limb of the device, thus reducing leakage around the tube. The afferent limb opens into an upstream location within the gastrointestinal tract, and the downstream limb opens into a downstream location within the gastrointestinal tract. The two limbs are connected to each other, this providing a bypass tract. The two limbs can be transiently isolated for purposes of delivering material, via the efferent limb, to the downstream location within the gastrointestinal tract.

The instant disclosure provides enteral feeding devices and methods of use thereof that are useful for delivering materials, including nutrients, water, and medications, directly into the gastrointestinal tract.

An aspect of the disclosure is an enteral feeding device, comprising a first tube comprising a wall and a proximal end and a distal end, the first tube defining a first lumen that extends longitudinally through at least a portion of the first tube, the first tube comprising at least one distal opening capable of allowing delivery of nutrients and/or medicaments from within the first lumen into a distal lumen of a gastrointestinal tract of a subject when the enteral feeding device is positioned in the subject; and a second tube, connected to and extending away from the first tube, comprising a proximal end and a distal end, the second tube defining a second lumen that extends longitudinally through at least a portion of the second tube and is in fluid communication with the first lumen via a reversibly closable proximal opening, the second tube comprising at least one distal opening capable of allowing delivery of fluid from within a proximal lumen of the gastrointestinal tract of the subject to at least one distal opening of the first tube when the enteral feeding device is positioned in the subject and the reversibly closable proximal opening is open.

In certain embodiments, the enteral feeding device further comprises an expandable placement/securement balloon and a third tube, wherein the balloon comprises an interior and an exterior and is attached to the exterior surface of the first tube distal to the connection between the first tube and the second tube, and wherein the third tube is connected to the first tube and to the balloon, the third tube comprising a proximal end and a distal end, the third tube defining a third lumen that extends longitudinally along at least a portion of the third tube, and the third tube comprising at least one distal opening capable of allowing reversible delivery of a fluid from within the third lumen into the interior of the balloon.

In certain embodiments, the enteral feeding device further comprises an expandable placement/securement balloon and a third tube, wherein the balloon comprises an interior and an exterior and is attached to the exterior surface of the first tube proximal to the connection between the first tube and the second tube, and wherein the third tube is connected to the first tube and to the balloon, the third tube comprising a proximal end and a distal end, the third tube defining a third lumen that extends longitudinally along at least a portion of the third tube, and the third tube comprising at least one distal opening capable of allowing reversible delivery of a fluid from within the third lumen into the interior of the balloon.

In certain embodiments, at least a proximal portion of the second tube is defined within a proximal portion of the wall of the first tube.

In certain embodiments, at least a proximal portion of the third tube is defined within a proximal portion of the wall of the first tube.

In certain embodiments, the proximal end of the first tube is constructed and arranged so as the first lumen is capable of receivably engaging a reservoir comprising the nutrients and/or medicaments.

In an embodiment, engagement of the reservoir by the first lumen reversibly closes the proximal opening of the second lumen.

In certain embodiments, any one or more of the first, second, and third tubes comprises a plurality of distal openings.

In certain embodiments, the first tube has a length in the range of about 5 cm to about 60 cm.

In certain embodiments, the first tube has an outside diameter in the range of about 2.5 mm to about 10 mm (i.e., about 7.5 French (FR) to about 30 FR).

In certain embodiments, any one or more of the first, second, and third tubes further comprises a fitting constructed and arranged to reversibly close the proximal end of said tube or tubes.

In certain embodiments, the first tube is a jejunostomy tube.

An aspect of the invention is a method for positioning the enteral feeding device according to the disclosure in a subject, comprising percutaneously introducing the distal end of the first tube and the distal end of the second tube into a lumen of the gastrointestinal tract of the subject;

positioning the distal end of the first tube in a distal aspect of the lumen of the gastrointestinal tract; and positioning the distal end of the second tube in a proximal aspect of the lumen of the gastrointestinal tract.

In certain embodiments, the positioning the distal end of the second tube in the proximal aspect of the lumen of the gastrointestinal tract comprises introducing a guidewire into the second lumen.

In certain embodiments, the positioning the distal end of the first tube in the distal aspect of the lumen of the gastrointestinal tract comprises introducing a first guidewire into the first lumen, and wherein the positioning the distal end of the second tube in the proximal aspect of the lumen of the gastrointestinal tract comprises introducing a second guidewire into the second lumen.

In certain embodiments, the distal aspect of the lumen of the gastrointestinal tract is within jejunum.

An aspect of the disclosure is a method of providing enteral support to a subject. The method comprises positioning the enteral feeding device in a subject in need thereof according method described above;

closing the proximal opening of the second lumen; and delivering nutrients and/or medicaments via the first lumen into the distal aspect of the lumen of the gastrointestinal tract of the subject.

In certain embodiments, the method further comprises opening the proximal opening of the second lumen after completing delivery of the nutrients and/or medicaments via the first lumen into the distal aspect of the lumen of the gastrointestinal tract of the subject.

An aspect of the disclosure is a method of reducing stoma inflammation in a subject receiving enteral support via an enteral feeding device. The method comprises positioning an enteral feeding device disclosed herein in a subject in need thereof according to the method described above; and maintaining the proximal opening of the second lumen in an open configuration between periods of delivery of nutrients and/or medicaments via the first lumen into the distal aspect of the lumen of the gastrointestinal tract of the subject.

DETAILED DESCRIPTION

Figure 1:
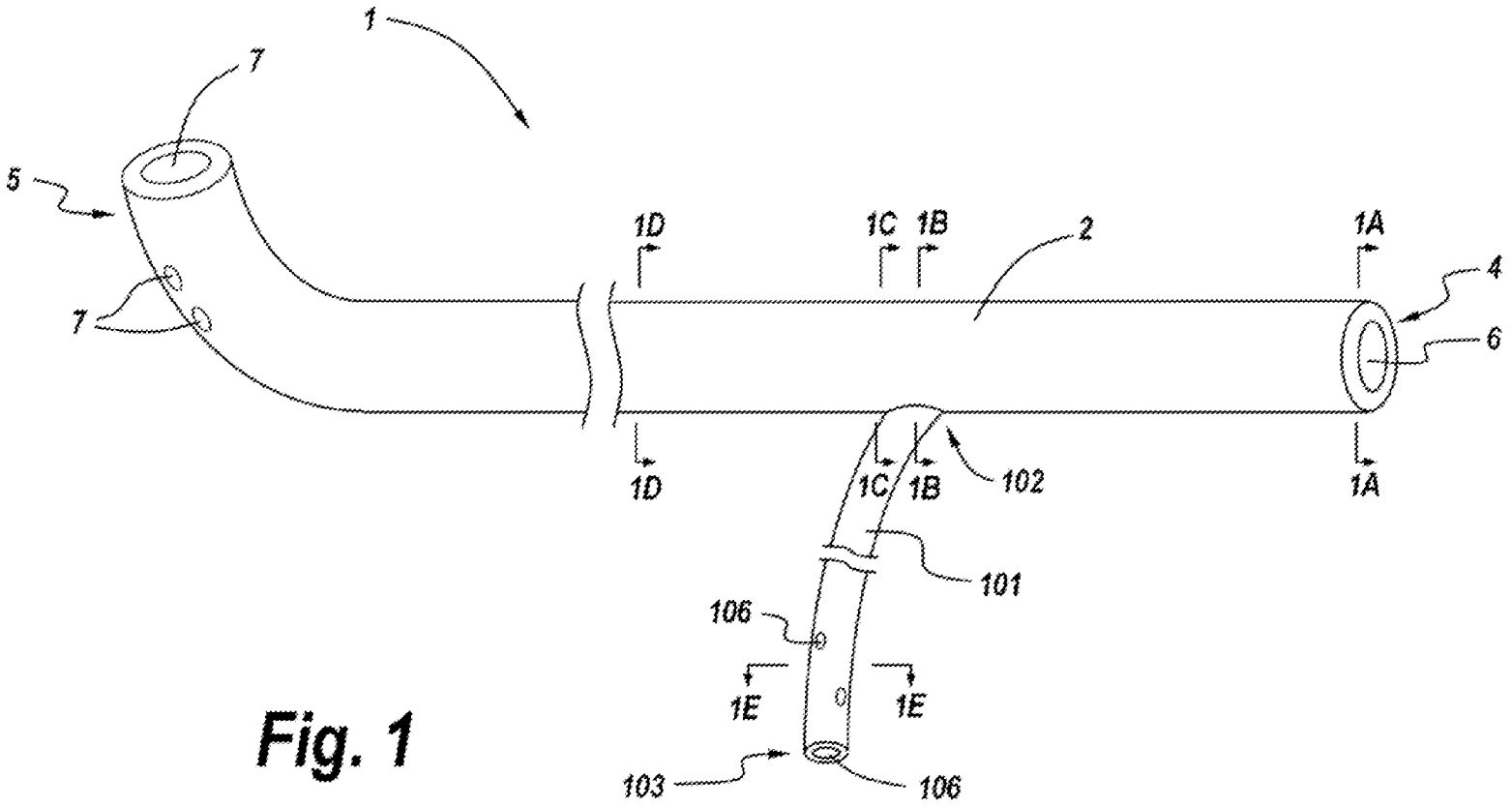
FIG. 1 depicts an exterior view of an embodiment of an enteral feeding device in accordance with the disclosure.
Figure 1A:
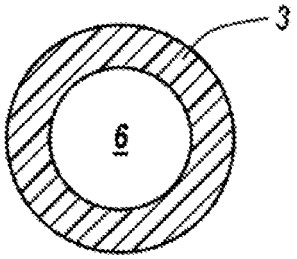
FIG. 1A depicts a transverse cross-sectional view of the tube of FIG. 1 taken at point A in FIG. 1.
Figure 1B:
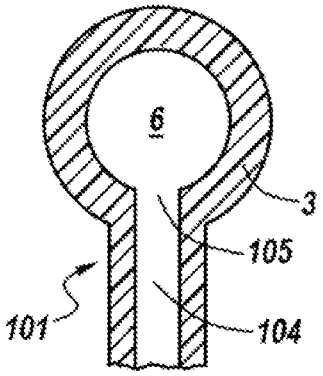
FIG. 1B depicts a transverse cross-sectional view of the tube of FIG. 1 taken at point B in FIG. 1.
Figure 1C:
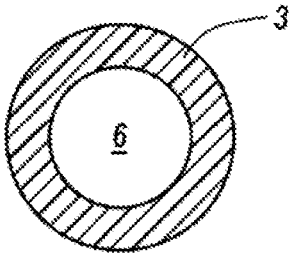
FIG. 1C depicts a transverse cross-sectional view of the tube of FIG. 1 taken at point C in FIG. 1.
Figure 1D:
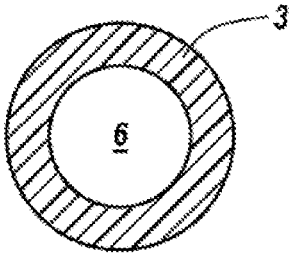
FIG. 1D depicts a transverse cross-sectional view of the tube of FIG. 1 taken at point D in FIG. 1.
Figure 1E:
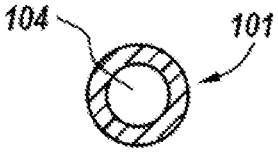
FIG. 1E depicts a transverse cross-sectional view of the tube of FIG. 1 taken at point E in FIG. 1.
Figure 2:
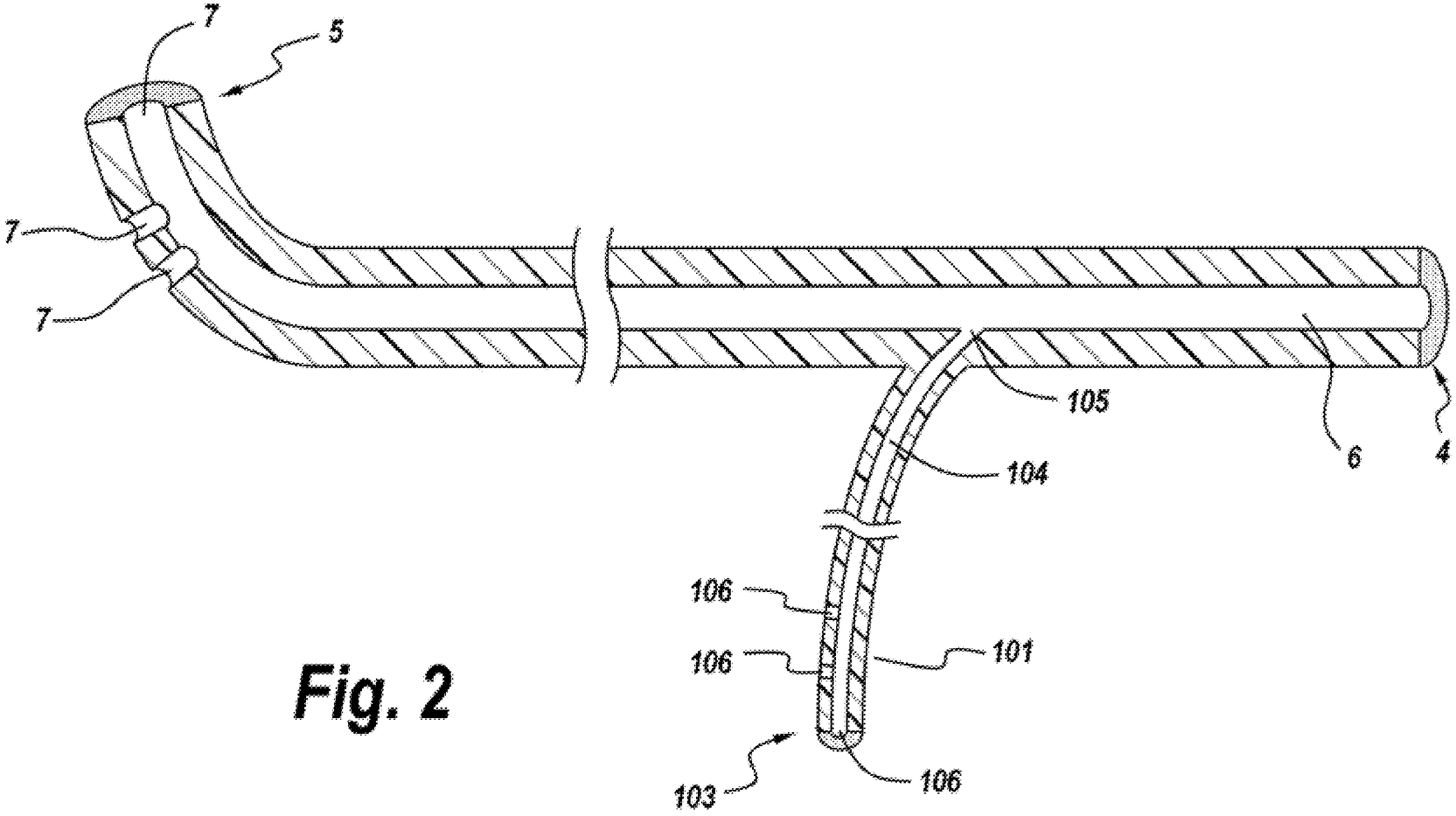
FIG. 2 depicts a longitudinal cross-sectional view of the tube of FIG. 1.

The invention will now be described with reference to the attached drawing Figures. Words such as "proximal" and "distal," as used herein with reference to an enteral feeding device, are meant to describe portions of or positions along the device that are closer to and further from, respectively, the end of the device that is intended to be external to the patient. Words such as "proximal" and "distal," as used herein with reference to a portion of a gastrointestinal tract, are relative terms that are to be understood in terms of the normal anatomy and function of the gastrointestinal tract. For example, the stomach is proximal to the jejunum. Further with regard to portions of the gastrointestinal tract, the terms "afferent" and "efferent," as used herein, are relative terms that are to be understood generally to mean "upstream" and "downstream" with respect to a given reference point along the gastrointestinal tract in accordance with its normal anatomy and function.

The instant disclosure provides enteral feeding devices and methods of use thereof that are useful for delivering nutrients, water and other liquids, and medications directly into the gastrointestinal tract, such devices constructed and arranged so as to have a reduced risk of leakage of gastrointestinal fluids around the enteral feeding devices, thereby reducing the risk of enteral feeding device-related morbidity.

A key feature of the present disclosure is the presence of a communicating opening in an enteral feeding device constructed and arranged so as to permit fluid to flow, within the device when the device is positioned in a subject, from an upstream location within the gastrointestinal tract of the subject to a downstream location within the gastrointestinal tract of the subject. In certain embodiments, the enteral feeding device comprises an afferent limb and an efferent limb, each limb defining a lumen and comprising a distal end with at least one distal opening to said lumen, the two lumens being in fluid communication with each other via the communicating opening, the distal end of the afferent limb being capable of placement in an upstream location within the gastrointestinal tract of a subject, and the distal end of the efferent limb being capable of placement in a downstream location within the gastrointestinal tract of the subject.

In certain embodiments, the communicating opening mentioned above is reversibly closable. That is, when the reversibly closable opening in the enteral feeding device is open, fluid is permitted to flow, within the device, from an upstream location within the gastrointestinal tract of a subject to a downstream location within the gastrointestinal tract of the subject. In certain embodiments, the enteral feeding device comprises an afferent limb and an efferent limb, each limb defining a lumen and having a distal end with at least one distal opening, the two lumens being in fluid communication via the reversibly closable opening when the reversibly closable opening in the enteral feeding device is open, the distal end of the afferent limb being capable of placement in an upstream location within the gastrointestinal tract of a subject, and the distal end of the efferent limb being capable of placement in a downstream location within the gastrointestinal tract of the subject.

The reversibly closable opening in the enteral feeding device can be closed during feeding so that nutrients or the like administered using the device do not pass through the reversibly closable opening but rather exit the lumen of the device in an efferent direction via the second opening in the device positioned in a distal aspect of the gastrointestinal tract.

Figure 4:
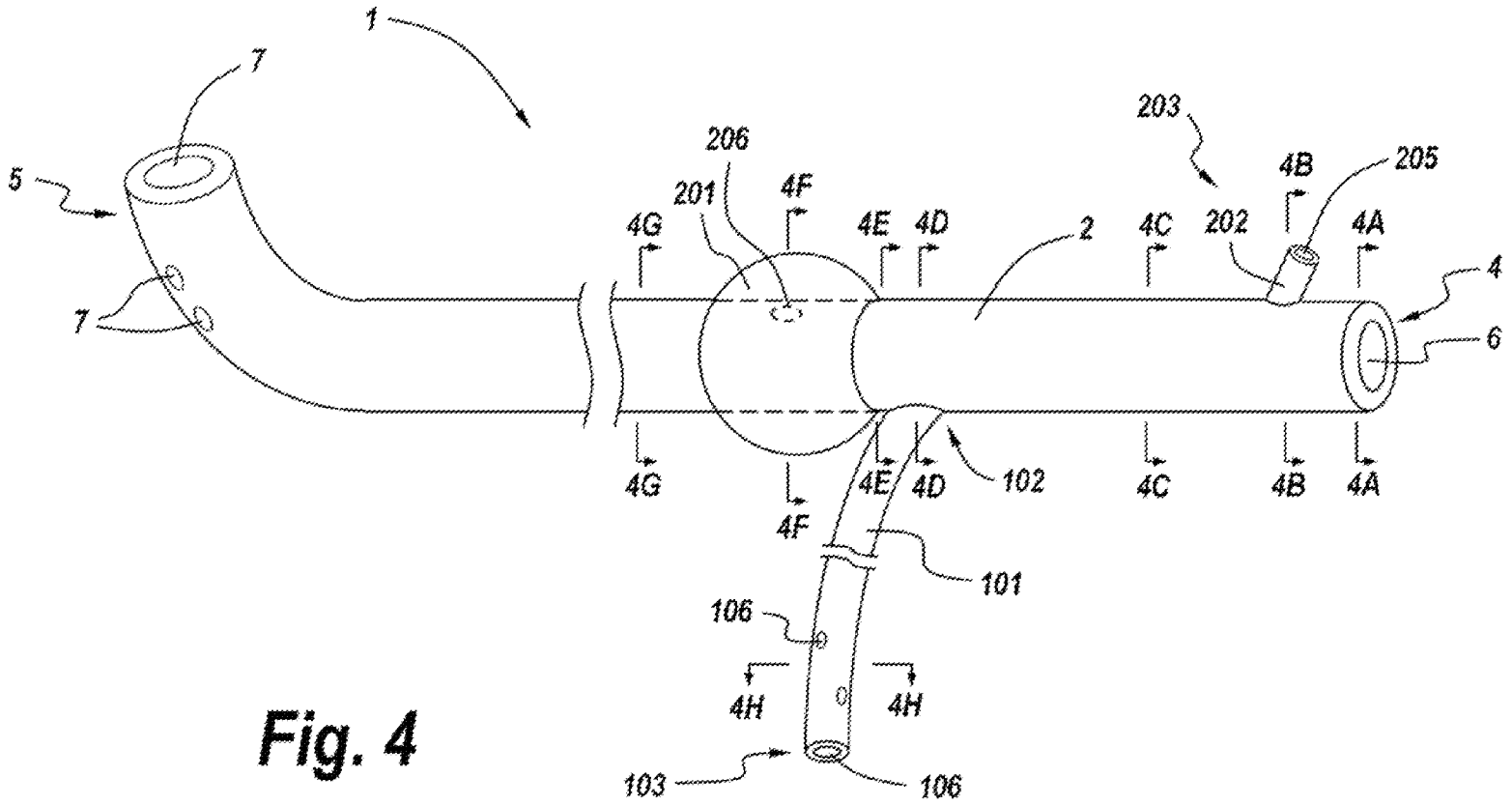
FIG. 4 depicts an exterior view of another embodiment of the enteral feeding tube in accordance with the disclosure.
Figure 4A:
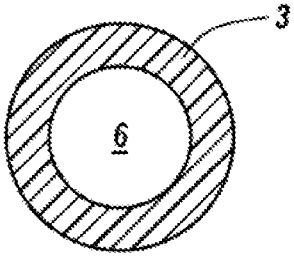
FIG. 4A depicts a transverse cross-sectional view of the tube of FIG. 4 taken at point A in FIG. 1.
Figure 4B:
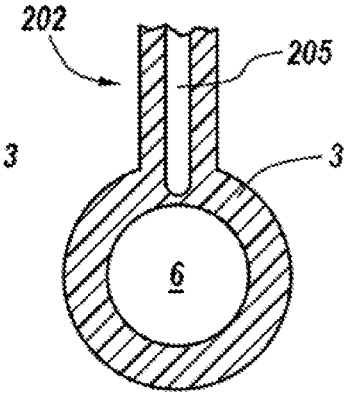
FIG. 4B depicts a transverse cross-sectional view of the tube of FIG. 4 taken at point B in FIG. 4.
Figure 4C:
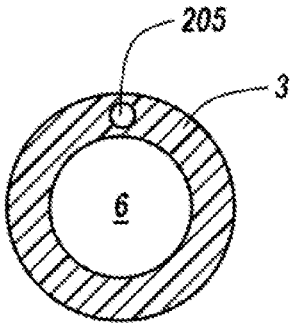
FIG. 4C depicts a transverse cross-sectional view of the tube of FIG. 4 taken at point C in FIG. 4.
Figure 4D:
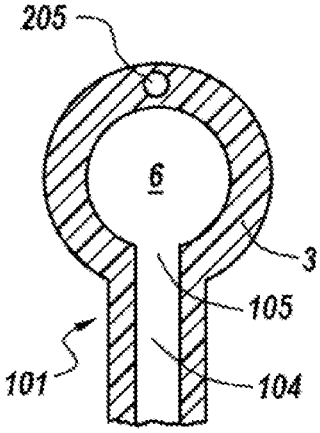
FIG. 4D depicts a transverse cross-sectional view of the tube of FIG. 4 taken at point D in FIG. 4.
Figure 4E:
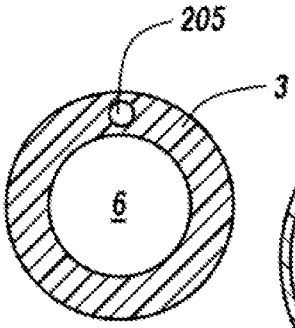
FIG. 4E depicts a transverse cross-sectional view of the tube of FIG. 4 taken at point E in FIG. 4.
Figure 4F:
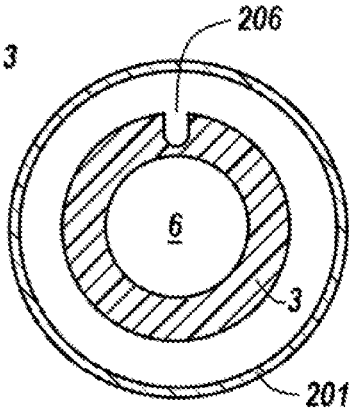
FIG. 4F depicts a transverse cross-sectional view of the tube of FIG. 4 taken at point F in FIG. 4.
Figure 4G:
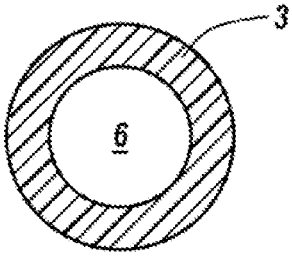
FIG. 4G depicts a transverse cross-sectional view of the tube of FIG. 4 taken at point Gin FIG. 4.
Figure 4H:
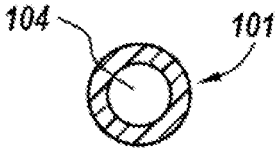
FIG. 4H depicts a transverse cross-sectional view of the tube of FIG. 4 taken at point H in FIG. 4.
Figure 5:
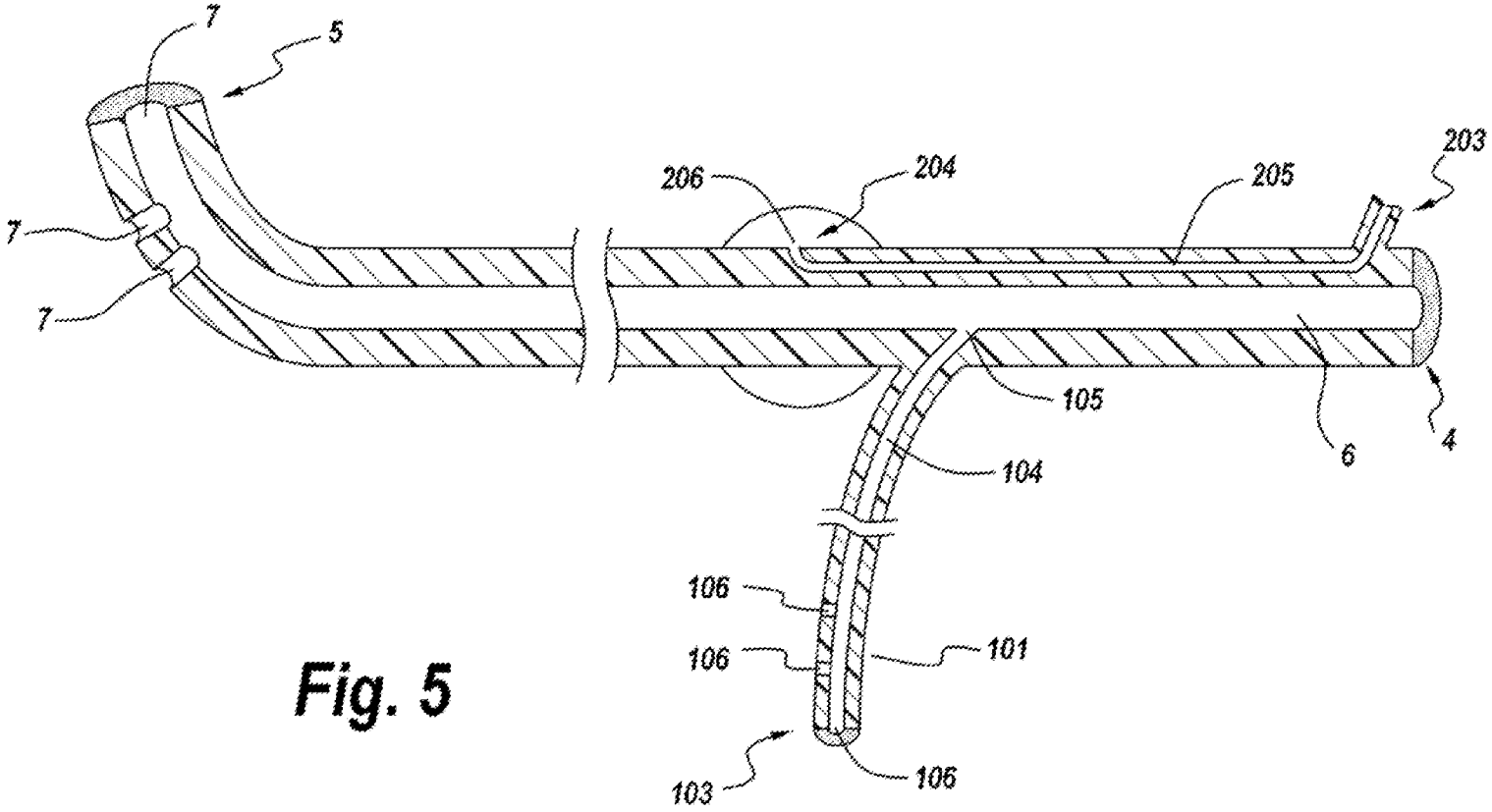
FIG. 5 depicts a longitudinal cross-sectional view of the tube of FIG. 4.

In a first embodiment, the invention will be described with respect to a representative J-tube device as shown in FIG. 1. This is for illustrative purposes only and should not be considered limiting to the variety of devices that can incorporate the inventive features herein. Other similar devices are shown in FIGS. 4-5. The various lengths and diameters depicted in the figures are not necessarily drawn to scale.

FIG. 1 shows an enteral feeding device 1, comprising a first tube 2 comprising a wall 3 and a proximal end 4 and a distal end 5, the first tube defining a first lumen 6 that extends longitudinally through at least a portion of the first tube, the first tube comprising at least one distal opening 7 capable of allowing delivery of nutrients and/or medicaments from within the first lumen into a distal lumen of a gastrointestinal tract of a subject when the enteral feeding device is positioned in the subject; and a second tube 101, connected to and extending away from the first tube, comprising a proximal end 102 and a distal end 103, the second tube defining a second lumen 104 that extends longitudinally through at least a portion of the second tube and is in fluid communication with the first lumen via a reversibly closable proximal opening 105, the second tube comprising at least one distal opening 106 capable of allowing delivery of fluid from within a proximal lumen of the gastrointestinal tract of the subject to at least one distal opening of the first tube when the enteral feeding device is positioned in the subject and the reversibly closable proximal opening is open.

Device 1 is generally a substantially Y- or T-shaped flexible or semi-rigid medical device comprising interconnected hollow tubes 2 and 101, constructed and arranged to be suitable for use as an enteral feeding device in a subject. Each of tubes 2 and 101 independently can be uniform in diameter or can taper in diameter in a proximal to distal direction.

In certain embodiments, the subject is a human; in various certain embodiments, such human subject can be adult, pediatric, neonatal, or preterm neonatal.

In typical use, distal end 5 is positioned in the jejunum or ileum of a subject and is capable of supplying the jejunum or ileum with material, such as nutrients, water, and medicines, through one or more distal openings 7. The one or more distal openings 7 can include one or more side openings and/or one or more end openings. In an embodiment, the one or more distal openings 7 include a plurality of side openings and one end opening. In an embodiment, the one or more distal openings 7 include a plurality of side openings. In an embodiment, the one or more distal openings 7 include just one side opening. In an embodiment, the one or more distal openings 7 include just one end opening. In an embodiment, the one or more distal openings 7 include just one side opening and just one end opening.

In typical use, proximal end 4 traverses the bowel wall and abdominal wall via a stoma or other suitable opening and is situated outside the body of the subject. Proximal end 4 is reversibly closable, for example with a clamp across tube 2 and/or a resealable plug or cap (not shown). For example, lumen 6 typically extends to and is otherwise open at proximal end 4, and proximal end 4 optionally can be fitted with a suitable cap that allows, as desired, reversible access to and closure of lumen 6 at its proximal end.

In typical use, lumen 6 is open for access at or near proximal end 4 during feedings, and not open for access, i.e., closed, at or near proximal end 4 in between feedings.

As used herein, "feeding" refers to any period of time during which lumen 6 is used to deliver material to the gastrointestinal tract of a subject in whom resides an enteral feeding device in accordance with the disclosure. A "feeding" as used herein can include but is not limited to a meal.

In an embodiment, lumen 6 at proximal end 4 is constructed and arranged so as to be capable of receivably engaging a tapered tip of, for example, a standard 50 cc syringe or other such container suitable as a source for the material to be delivered via tube 2. In certain embodiments, such container can include a bag or reservoir fitted with such a tapered tip, or fitted with a tube having such a tip at a free end.

Lumen 6 traverses substantially the entire length of tube 2 and has at least one opening at or near proximal end 4 and at least one opening at or near distal end 5. Lumen 6 and at least one distal opening 106 are constructed and arranged so to be capable of accommodating a guidewire or stylet for use in positioning tube 2 in a subject.

Referring now to FIGS. 1, 1A-1E, and 2, joined to tube 2 is a second tube or member 101 positioned such that in use its proximal end 102 will be situated within the lumen of the subject's gastrointestinal tract. Typically, tube 2 and tube 101 are joined as a single workpiece by virtue of the manner by which device 1 is molded or extruded. Alternatively, tube 2 and tube 101 can be manufactured separately and joined together using suitable adhesive, heat-welding, fitting, or the like. The azimuthal angle at which tube 2 and tube 101 are joined generally is not critical, provided such angle does not impair or defeat the purpose and advantages of the device.

In certain embodiments, joined to tube 2 is a plurality of second tubes or members 101 positioned such that in use each proximal end 102 will be situated within the lumen of the subject's gastrointestinal tract.

Lumen 104 traverses substantially the entire length of tube 101, joins and is in fluid communication with lumen 6 at or near proximal end 102, and has at least one opening at or near distal end 103.

In typical use, distal end 103 is positioned in the duodenum or ileum of a subject, proximal to where device 1 enters the gastrointestinal tract, and is capable of receiving gastrointestinal fluid from an afferent direction, through one or more distal openings 106. The one or more distal openings 106 can include one or more side openings and/or one or more end openings. In an embodiment, the one or more distal openings 106 include a plurality of side openings and one end opening.

Importantly, lumen 104 communicates with lumen 6 via a reversibly closable proximal opening 105. When reversibly closable proximal opening 105 is open, fluid flowing from an afferent direction in the gut can enter lumen 104, flow into lumen 6, and ultimately drain in an efferent direction into distal gut via one or more openings 7. In accordance with the scenario just described, typically, the proximal end of lumen 6 is not open (e.g., is capped), such that fluid entering lumen 6 from lumen 104 cannot leave via the proximal end of lumen 6.

Figure 3:
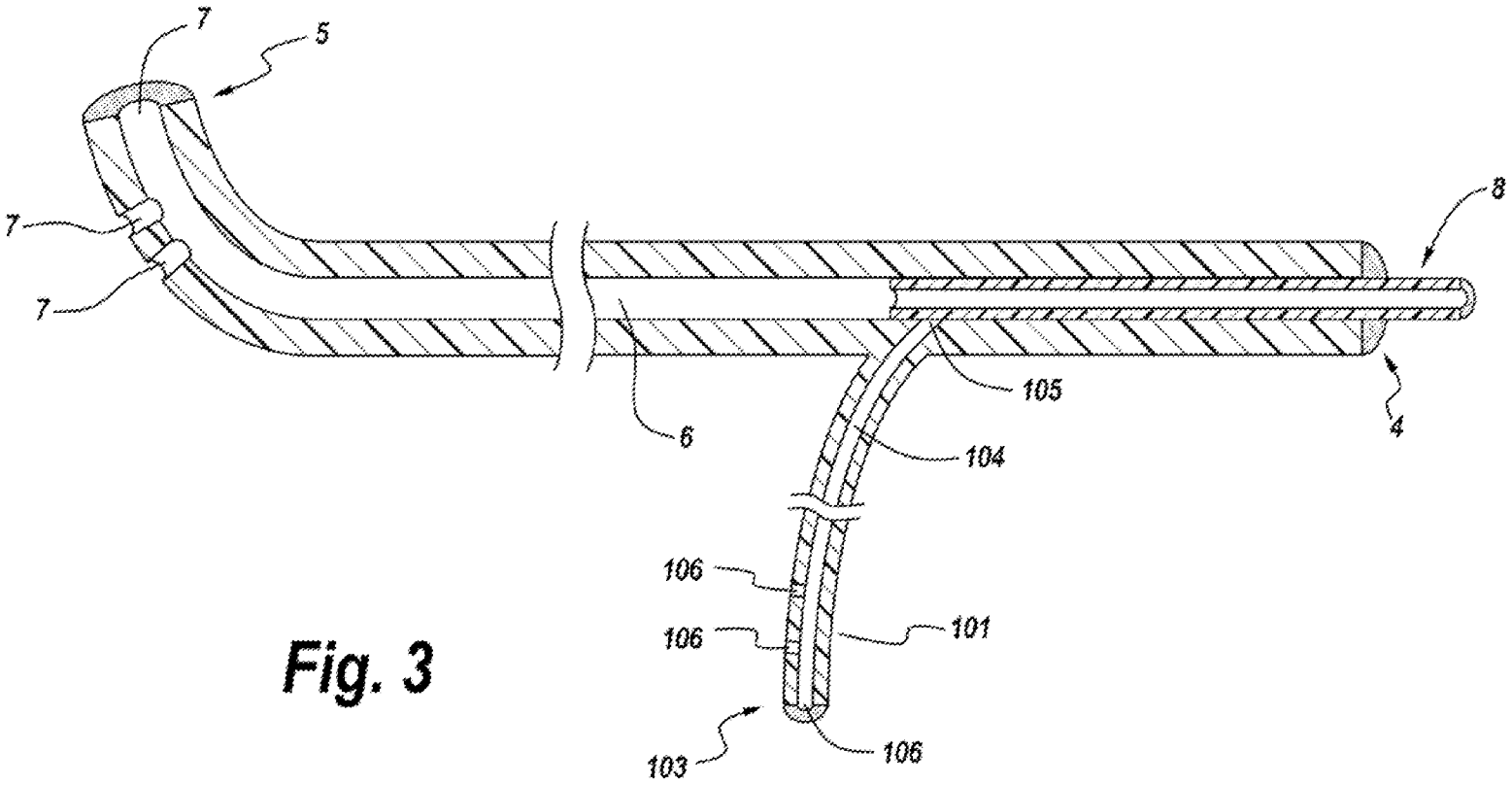
FIG. 3 depicts a longitudinal cross-sectional view of the tube of FIG. 1 with a male member engaged in the main lumen such that access to the lumen of the side tube is closed while access to the main lumen remains open.

Referring to FIG. 3, a suitably sized separate tube or tapered male member 8 can be removably inserted into lumen 6 such that it extends across reversibly closable proximal opening 105, thereby effectively and reversibly closing reversibly closable proximal opening 105.

When reversibly closable proximal opening 105 is not open, fluid flowing from an afferent direction in the gut cannot enter lumen 104 or flow into lumen 6. In accordance with the scenario just described, typically, the proximal end of lumen 6 is open (e.g., is not capped), such that fluid entering lumen 6 from proximal end 4 traverses the length of lumen 6 and empties into distal gut via one or more openings 7. In an embodiment, reversibly closable proximal opening 105 is not open, for example, during a feeding, by virtue of lumen 6 at proximal end 4 being receivably engaged by a tapered tip of, for example, a standard 50 cc syringe or other such container suitable as a source for the material to be delivered via tube 2. In an embodiment, the tapered tip so engaged by lumen 6 at proximal end 4 extends to and substantially covers or occludes reversibly closable proximal opening 105. In this manner, material being delivered to the subject via one or more distal openings 106 cannot flow in a "reverse" direction, i.e., from lumen 6 into lumen 104.

FIG. 4 shows an enteral feeding device 1, comprising a first tube 2 comprising a wall 3 and a proximal end 4 and a distal end 5, the first tube defining a first lumen 6 that extends longitudinally through at least a portion of the first tube, the first tube comprising at least one distal opening 7 capable of allowing delivery of nutrients and/or medicaments from within the first lumen into a distal lumen of a gastrointestinal tract of a subject when the enteral feeding device is positioned in the subject; and a second tube 101, connected to and extending away from the first tube, comprising a proximal end 102 and a distal end 103, the second tube defining a second lumen 104 that extends longitudinally through at least a portion of the second tube and is in fluid communication with the first lumen via a reversibly closable proximal opening 105, the second tube comprising at least one distal opening 106 capable of allowing delivery of fluid from within a proximal lumen of the gastrointestinal tract of the subject to at least one distal opening of the first tube when the enteral feeding device is positioned in the subject and the reversibly closable proximal opening is open, further comprising an expandable placement/securement balloon 201 and a third tube 202, wherein the balloon comprises an interior and an exterior and is attached to the exterior surface of the first tube distal to the connection between the first tube and the second tube, and wherein the third tube is connected to the first tube and to the balloon, the third tube comprising a proximal end 203 and a distal end 204, the third tube defining a third lumen 205 that extends longitudinally along at least a portion of the third tube, and the third tube comprising at least one distal opening 206 capable of allowing reversible delivery of a fluid from within the third lumen into the interior of the balloon.

In certain alternative embodiments, the enteral feeding device is like the device just described in connection with FIG. 4, except the expandable placement/securement balloon 201 is attached to the exterior surface of the first tube proximal to the connection between the first tube and the second tube.

Referring now to FIGS. 4, 4A-4H, and 5, the enteral feeding device shown in FIG. 4 includes all of the features of the enteral feeding device shown and described in connection with FIG. 1, plus an expandable placement/securement balloon 201 and inflation lumen 205 for said balloon. Balloon 201 is constructed and arranged to secure device 1 within the subject. Balloon 201 can be glued or otherwise adhered to the exterior surface of tube 2 which can have an opening 206 therethrough for introducing air, saline, or other fluid into the expandable balloon. Inflation tube 202 defines lumen 205 and typically runs, in part, within wall 3 of tube 2 and terminates at its distal end with opening 206. At its proximal end 203, tube 202 is typically fitted with a resealable closure, valve, or septum for introducing air, water, saline, or other fluid into expandable balloon 201. In use, balloon 201 is typically uninflated during placement of the device into the subject. Once in place, then balloon 201 typically is inflated to achieve a diameter sufficient to secure the tube in place but not so much as to obstruct the bowel. Balloon 201 can be deflated for removal of the device from the subject.

Other configurations for tube 202 are contemplated by the disclosure. For example, tube 2 and tube 202 can be substantially coaxial, side-by-side, etc.

In certain embodiments, the enteral feeding device is a J-tube.

In certain embodiments, the first tube has a length in the range of about 5 cm to about 60 cm. In certain embodiments, the first tube has a length in the range of about 5 cm to about 50 cm. In certain embodiments, the first tube has a length in the range of about 5 cm to about 40 cm. In certain embodiments, the first tube has a length in the range of about 5 cm to about 30 cm. In certain embodiments, the first tube has a length in the range of about 5 cm to about 20 cm. In certain embodiments, the first tube has a length in the range of about 10 cm to about 60 cm. In certain embodiments, the first tube has a length in the range of about 10 cm to about 50 cm. In certain embodiments, the first tube has a length in the range of about 10 cm to about 40 cm. In certain embodiments, the first tube has a length in the range of about 10 cm to about 30 cm. In certain embodiments, the first tube has a length in the range of about 10 cm to about 20 cm. In certain embodiments, the first tube has a length in the range of about 15 cm to about 60 cm. In certain embodiments, the first tube has a length in the range of about 15 cm to about 50 cm. In certain embodiments, the first tube has a length in the range of about 15 cm to about 40 cm. In certain embodiments, the first tube has a length in the range of about 15 cm to about 30 cm. In certain embodiments, the first tube has a length in the range of about 15 cm to about 20 cm. In certain embodiments, the first tube has a length in the range of about 20 cm to about 60 cm. In certain embodiments, the first tube has a length in the range of about 20 cm to about 50 cm. In certain embodiments, the first tube has a length in the range of about 20 cm to about 40 cm. In certain embodiments, the first tube has a length in the range of about 20 cm to about 30 cm. In certain embodiments, the first tube has a length in the range of about 25 cm to about 60 cm. In certain embodiments, the first tube has a length in the range of about 25 cm to about 50 cm. In certain embodiments, the first tube has a length in the range of about 25 cm to about 40 cm. In certain embodiments, the first tube has a length in the range of about 25 cm to about 30 cm.

In certain embodiments, the first tube has an outside diameter in the range of about 2.5 mm to about 10 mm (i.e., about 7.5 French (FR) to about 30 FR). In certain embodiments, the first tube has an outside diameter in the range of about 4 mm to about 8 mm (i.e., about 12 French (FR) to about 24 FR). In certain embodiments, the first tube has an outside diameter of about 4 mm (12 FR). In certain embodiments, the first tube has an outside diameter of about 4.67 mm (14 FR). In certain embodiments, the first tube has an outside diameter of about 5.33 mm (16 FR). In certain embodiments, the first tube has an outside diameter of about 6 mm (18 FR). In certain embodiments, the first tube has an outside diameter of about 6.67 mm (20 FR). In certain embodiments, the first tube has an outside diameter of about 7.33 mm (22 FR). In certain embodiments, the first tube has an outside diameter of about 8 mm (24 FR).

In certain embodiments, the enteral feeding device further comprises an external securement ring or flange suitable to secure the device in contact with the skin.

In making the tubes and other body components of the enteral feeding tubes herein, it is within the scope of the invention to include reinforcing materials (e.g., metals, and composite fillers) within the materials used to make any of the embodiments of the first tube and other tubes, balloons, and related features of the device where indicated. In addition, additives for sterility (such as silver and the like) and for radio-opacity may also be incorporated.

The materials used to make the structural components may be those known in the art or to be developed for G-tube, J-tube, NG-tubes and other similar devices, such as various types of catheter tubing. Such materials may be formed, for example, from conventional elastomeric polyurethanes such as those sold under the trademarks ESTANE® and PELLETHANE® from B. F. Goodrich and Dow Chemical Company, respectively. Other polymeric materials such as polyvinyl chloride, styrenic polymers such as KRATON®, polyacrylates, polyolefins, polyamides, polyesters, fluoropolymers, silicones, polyphosphazenes, perfluoroelastomers, fluroelastomers, and copolymers, derivatives, blends and alloys of such polymers may be used. Such materials are conventionally employed in the art to prepare such devices, and can be employed to fabricate the tubular components by extrusion, insert molding, mandrel techniques and other various methods. Coatings for strengthening, sterilization, radio-opaque, acid-resistance and other special properties and additives as well to achieve such properties may also be used, such as polyp-xylene) polymer as described in WO 95/04564 incorporated with respect to the description of use of such polymer herein.

In various embodiments herein, the wall is preferably made of a flexible polymeric material. Such materials are known in the art and can include polyurethanes, polyamides (such as nylon-12), polyether block amides (such as the material sold under the trademark PEBAX), polyethylene, and polyethylene terephthalate, polybutylene terephthalate, polyester elastomers including those that use a polyester as a hard segment, polyolefins (such as polyethylene, polypropylene, polybutylene and combinations and co-polymers thereof), polyolefin elastomers, vinyl-based polymers (such as polyvinyl chloride, polyvinylidene chloride, or polyvinylidene fluoride), polyamide elastomers, polyimides, polystyrenes, styrene-ethylene/butylene-styrene resins, polyurethane elastomers, acrylonitrile-butadiene-styrene resins, acrylic resins, polyarylates, polycarbonates, polyoxymethylenes, polyvinyl alcohol, and fluorocarbon resins, such as ethylenetetrafluoroethylene, perfluoroalkoxy copolymer, polytetrafluoroethylene, fluoroelastomers, perfluoroelastomers, and copolymers, derivatives, combinations, alloys and the like of these materials, provided that the property of the material should be selected so as to be capable of being inflated without breaking upon introduction of a fluid, such as water, saline, air, etc. into the inflatable balloon. Such materials are known in the art and are preferably the same as are traditionally used to make the placement/securement balloon used on traditional J-tubes and G-tubes and/or that are used on angioplasty catheters having expandable balloons used in heart treatment, or expandable balloons used in hemodialytic catheters.

Also provided is a method for diverting gastrointestinal fluid from an upstream location within the gastrointestinal tract of a subject to a downstream location within the gastrointestinal tract of the subject. The method comprises providing a fluid path within an enteral feeding device permitting fluid to flow, within the device when the device is positioned in the subject, from an upstream location within the gastrointestinal tract of the subject to a downstream location within the gastrointestinal tract of the subject. In certain embodiments, the enteral feeding device used in accordance with the method comprises an afferent limb and an efferent limb, each limb defining a lumen and comprising a distal end with at least one distal opening to said lumen, the two lumens being in fluid communication with each other via a communicating opening, the distal end of the afferent limb being capable of placement in an upstream location within the gastrointestinal tract of a subject, and the distal end of the efferent limb being capable of placement in a downstream location within the gastrointestinal tract of the subject.

In certain embodiments, the communicating opening mentioned above is reversibly closable. That is, when the reversibly closable opening in the enteral feeding device is open, fluid is permitted to flow, within the device, from an upstream location within the gastrointestinal tract of a subject to a downstream location within the gastrointestinal tract of the subject. In certain embodiments, the enteral feeding device comprises an afferent limb and an efferent limb, each limb defining a lumen and having a distal end with at least one distal opening, the two lumens being in fluid communication via the reversibly closable opening when the reversibly closable opening in the enteral feeding device is open, the distal end of the afferent limb being capable of placement in an upstream location within the gastrointestinal tract of a subject, and the distal end of the efferent limb being capable of placement in a downstream location within the gastrointestinal tract of the subject.

Also provided is a method for positioning an enteral feeding device according to the disclosure in a subject. The method comprises percutaneously introducing the distal end of the first tube and the distal end of the second tube into a lumen of the gastrointestinal tract of the subject;

positioning the distal end of the first tube in a distal aspect of the lumen of the gastrointestinal tract; and positioning the distal end of the second tube in a proximal aspect of the lumen of the gastrointestinal tract.

The enteral feeding device can be introduced into the lumen of the gastrointestinal tract of a subject in a manner similar to other enteral feeding devices. Generally, this involves creation of a stoma or other opening between the desired region of the gut and the outer surface of the abdominal wall. The opening is preferably large enough to accommodate the device without difficulty but not so large as to leave a substantial gap between the body opening and the tube. Such access having been made, referring to FIG. 1 or FIG. 4, a guidewire or stylet is optionally introduced into lumen 6 and/or into lumen 104, and the distal end of the first tube and the distal end of the second tube are introduced into a lumen of the gastrointestinal tract of the subject, e.g., into the lumen of the jejunum. The distal end of the first tube is positioned in a distal aspect of the lumen of the gastrointestinal tract, for example by simple proper selection of the general direction of introduction. Alternatively, the distal end of the first tube is positioned in a distal aspect of the lumen of the gastrointestinal tract by, for example, advancing a first guidewire and/or stylet into the desired position, as determined by fluoroscopy, and then advancing the first tube over the first guidewire or stylet. Similarly, the distal end of the second tube is positioned in a proximal aspect of the lumen of the gastrointestinal tract, for example by simple proper selection of the general direction of introduction. Alternatively, the distal end of the second tube is positioned in a proximal aspect of the lumen of the gastrointestinal tract by, for example, advancing a second guidewire and/or stylet into the desired position, as determined by fluoroscopy, and then advancing the second tube over the second guidewire or stylet. The two tubes can be positioned in either order, i.e., first tube followed by second tube, or second tube followed by first tube, provided they are positioned to work as intended.

In an embodiment, the positioning the distal end of the second tube in the proximal aspect of the lumen of the gastrointestinal tract comprises introducing a guidewire and/or stylet into the second lumen. In an embodiment, the positioning the distal end of the second tube in the proximal aspect of the lumen of the gastrointestinal tract comprises introducing a guidewire into the second lumen. In an embodiment, the positioning the distal end of the second tube in the proximal aspect of the lumen of the gastrointestinal tract comprises introducing a stylet into the second lumen.

In an embodiment, the positioning the distal end of the first tube in the distal aspect of the lumen of the gastrointestinal tract comprises introducing a first guidewire and/or stylet into the first lumen, and the positioning the distal end of the second tube in the proximal aspect of the lumen of the gastrointestinal tract comprises introducing a second guidewire and/or stylet into the second lumen. In an embodiment, the positioning the distal end of the first tube in the distal aspect of the lumen of the gastrointestinal tract comprises introducing a first guidewire into the first lumen, and the positioning the distal end of the second tube in the proximal aspect of the lumen of the gastrointestinal tract comprises introducing a second guidewire into the second lumen. In an embodiment, the positioning the distal end of the first tube in the distal aspect of the lumen of the gastrointestinal tract comprises introducing a first stylet into the first lumen, and the positioning the distal end of the second tube in the proximal aspect of the lumen of the gastrointestinal tract comprises introducing a second stylet into the second lumen. In an embodiment, the positioning the distal end of the first tube in the distal aspect of the lumen of the gastrointestinal tract comprises introducing a guidewire into the first lumen, and the positioning the distal end of the second tube in the proximal aspect of the lumen of the gastrointestinal tract comprises introducing a stylet into the second lumen. In an embodiment, the positioning the distal end of the first tube in the distal aspect of the lumen of the gastrointestinal tract comprises introducing a stylet into the first lumen, and the positioning the distal end of the second tube in the proximal aspect of the lumen of the gastrointestinal tract comprises introducing a guidewire into the second lumen.

In an embodiment, the distal aspect of the lumen of the gastrointestinal tract is within jejunum.

Also provided is a method of providing enteral support to a subject. The method comprises positioning an enteral feeding device of the disclosure in a subject in need thereof according to the method described above;

closing the proximal opening of the second lumen; and delivering nutrients and/or medicaments via the first lumen into the distal aspect of the lumen of the gastrointestinal tract of the subject.

In an embodiment, the method further comprises opening the proximal opening of the second lumen after completing delivery of the nutrients and/or medicaments via the first lumen into the distal aspect of the lumen of the gastrointestinal tract of the subject.

Also provided is a method of reducing stoma inflammation in a subject receiving enteral support via an enteral feeding device. The method comprises positioning an enteral feeding device of the disclosure in a subject in need thereof according to the method described above; and maintaining the proximal opening of the second lumen in an open configuration between periods of delivery of nutrients and/or medicaments via the first lumen into the distal aspect of the lumen of the gastrointestinal tract of the subject. In certain embodiments, the subject has stoma inflammation with a conventional enteral feeding device, e.g., conventional J-tube, and the inflammation is reduced following replacement of the conventional enteral feeding device with a feeding device of the instant invention. In certain embodiments, the subject has stoma for use with an enteral feeding device, and stoma inflammation with a feeding device of the instant invention is reduced compared to expected stoma inflammation with a conventional enteral feeding device, e.g., conventional J-tube. In certain embodiments, the subject has stoma for use with an enteral feeding device, and stoma inflammation with a feeding device of the instant invention is reduced compared to observed stoma inflammation with a conventional enteral feeding device, e.g., conventional J-tube.

Also provided is a kit comprising an enteral feeding device of the disclosure and at least one guidewire or stylet selected from the group consisting of a guidewire for lumen 6, a guidewire for lumen 104, a stylet for lumen 6, a stylet for lumen 104, and any combination thereof. The kit optionally can include instructions for how to position the enteral feeding device in a subject. The kit optionally can include instructions for how to use the enteral feeding device to deliver material to the gastrointestinal tract of a subject.

Referring again to FIG. 1, another embodiment is a method of assembling an enteral feeding device 1 in which main tube 2 and second tube 101 are provided separately. At the juncture where second tube 101 is shown to join tube 2, there is instead an accessory opening through the wall of tube 2. The enteral feeding device 1 is introduced into the gastrointestinal tract in the same manner as explained above, but without the second tube 101. If leakage from tube 2 later develops, this can be remedied in situ (while still implanted in the gastrointestinal tract) by inserting a guidewire into first lumen 6 of tube 2. The guidewire is then passed through and out the accessory opening, into the lumen of the gastrointestinal tract. The distal end of accessory second tube 101 is then passed over the guidewire, into the lumen of tube 2, and out the accessory opening of tube 2. The proximal end of second tube 101 is positioned such that lumen 104 of tube 101 opens within, and is in fluid communication with, lumen 6. In accordance with this embodiment, in certain embodiments the proximal end of second tube 2 optionally can be flanged such that it can be seated snugly against the inner surface of wall 3. This results in an assembled enteral feeding device 1 in which second tube 101 is coupled to tube 2. Also provided is a enteral feeding device kit comprising a main tube 2 having an accessory opening as explained above, an accessory second tube 101 (not joined to the main tube), and a guidewire having sufficient length for passing through main tube 2 and out the accessory opening of main tube 2.

Similarly, referring again to FIG. 4, another embodiment is a method of assembling an enteral feeding device 1 in which main tube 2 and second tube 101 are provided separately. At the juncture where second tube 101 is shown to join tube 2, there is instead an accessory opening through the wall of tube 2. The enteral feeding device 1 is introduced into the gastrointestinal tract in the same manner as explained above, but without the second tube 101. If leakage from tube 2 later develops, this can be remedied in situ (while still implanted in the gastrointestinal tract) by inserting a guidewire into first lumen 6 of tube 2. The guidewire is then passed through and out the accessory opening, into the lumen of the gastrointestinal tract. The distal end of accessory second tube 101 is then passed over the guidewire, into the lumen of tube 2, and out the accessory opening of tube 2. The proximal end of second tube 101 is positioned such that lumen 104 of tube 101 opens within, and is in fluid communication with, lumen 6. In accordance with this embodiment, in certain embodiments the proximal end of second tube 2 optionally can be flanged such that it can be seated snugly against the inner surface of wall 3. This results in an assembled enteral feeding device 1 in which second tube 101 is coupled to tube 2.

Also provided is a enteral feeding device kit comprising a main tube 2 having an accessory opening as explained above, an accessory second tube 101 (not joined to the main tube), and a guidewire having sufficient length for passing through main tube 2 and out the accessory opening of main tube 2.

EXAMPLE

Figure 6:
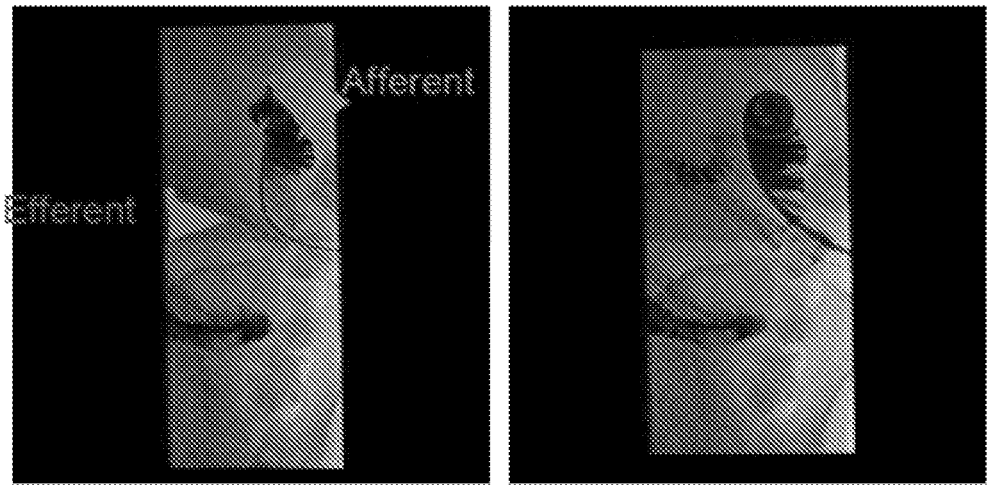
FIG. 6 is of pair of radiographs depicting a J-tube in the efferent limb and a second tube in the afferent limb of small bowel in a patient. Contrast material within the two tubes and gastrointestinal tract appears dark. Afferent and efferent limbs are indicated.

A patient with a J-tube had chronic leakage around the J-tube causing skin irritation and requiring over 10 hospital admissions. The tube had already been upsized to 24 Fr (largest available). A second tube was placed in the afferent limb to drain incoming secretions. FIG. 6 is a pair of radiographs depicting the first tube in the efferent limb and the second tube in the afferent limb of small bowel in the patient. Contrast material within the device and gastrointestinal tract appears dark. Afferent and efferent limbs are as indicated in the figure. Continuous wetting of dressings ceased immediately, and skin inflammation recovered in 2 weeks. When the secondary drainage catheter was displaced during patient movement in a rehabilitation facility on two separate occasions following placement, the leakage and associated irritation returned.

The invention claimed is:

1. An enteral feeding device, comprising a first tube comprising a wall and a proximal end and a distal end, the first tube defining a first lumen that extends longitudinally through at least a portion of the first tube, the first tube comprising at least one distal opening capable of allowing delivery of nutrients and/or medicaments from within the first lumen into a distal lumen of a gastrointestinal tract of a subject when the enteral feeding device is positioned in the subject;

a member configured to be inserted into the first lumen such that the member extends across a reversibly closable proximal opening thereby effectively and reversibly closing the reversibly closable proximal opening; and a second tube, connected to and extending away from the first tube, comprising a proximal end and a distal end, the second tube defining a second lumen that extends longitudinally through at least a portion of the second tube and is in fluid communication with the first lumen via the reversibly closable proximal opening, the second tube comprising at least one distal opening capable of allowing flow of fluid from within a proximal lumen of the gastrointestinal tract of the subject to the at least one distal opening of the first tube via the second lumen and the first lumen when the enteral feeding device is positioned in the subject and the reversibly closable proximal opening is open.

2. The enteral feeding device according to claim 1, further comprising an expandable placement/securement balloon and a third tube, wherein the balloon comprises an interior and an exterior and is attached to an exterior surface of the first tube distal to the connection between the first tube and the second tube, and wherein the third tube is connected to the first tube and to the balloon, the third tube comprising a proximal end and a distal end, the third tube defining a third lumen that extends longitudinally along at least a portion of the third tube, and the third tube comprising at least one distal opening capable of allowing reversible delivery of a fluid from within the third lumen into the interior of the balloon.

3. The enteral feeding device according to claim 2, wherein at least a proximal portion of the third tube is defined within a proximal portion of the wall of the first tube.

4. The enteral feeding device according to claim 1, further comprising an expandable placement/securement balloon and a third tube, wherein the balloon comprises an interior and an exterior and is attached to an exterior surface of the first tube proximal to the connection between the first tube and the second tube, and wherein the third tube is connected to the first tube and to the balloon, the third tube comprising a proximal end and a distal end, the third tube defining a third lumen that extends longitudinally along at least a portion of the third tube, and the third tube comprising at least one distal opening capable of allowing reversible delivery of a fluid from within the third lumen into the interior of the balloon.

5. The enteral feeding device according to claim 1, wherein at least a proximal portion of the second tube is defined within a proximal portion of the wall of the first tube.

6. The enteral feeding device according to claim 1, wherein the proximal end of the first tube is constructed and arranged so as the first lumen is capable of receivably engaging a reservoir comprising the nutrients and/or medicaments.

7. The enteral feeding device according to claim 6, wherein the reversibly closable proximal opening is a proximal opening of the second lumen; wherein engagement of the reservoir by the first lumen reversibly closes the proximal opening of the second lumen.

8. The enteral feeding device according to claim 1, wherein any one or more of the first and second tubes comprises a plurality of distal openings.

9. The enteral feeding device according to claim 1, wherein any one or more of the first and second tubes further comprises a fitting constructed and arranged to reversibly close the proximal end of said tube or tubes.

10. The enteral feeding device according to claim 1, wherein the first tube is a jejunostomy tube.

11. A method for positioning the enteral feeding device according to claim 1 in a subject, comprising percutaneously introducing the distal end of the first tube and the distal end of the second tube into a lumen of the gastrointestinal tract of the subject;

positioning the distal end of the first tube in a distal aspect of the lumen of the gastrointestinal tract; and positioning the distal end of the second tube in a proximal aspect of the lumen of the gastrointestinal tract.

12. The method according to claim 11, wherein the positioning the distal end of the second tube in the proximal aspect of the lumen of the gastrointestinal tract comprises introducing a guidewire into the second lumen.

13. The method according to claim 11, wherein the positioning the distal end of the first tube in the distal aspect of the lumen of the gastrointestinal tract comprises introducing a first guidewire into the first lumen, and wherein the positioning the distal end of the second tube in the proximal aspect of the lumen of the gastrointestinal tract comprises introducing a second guidewire into the second lumen.

14. The method according to claim 11, wherein the distal aspect of the lumen of the gastrointestinal tract is within jejunum.

15. A method of providing enteral support to a subject, comprising positioning the enteral feeding device in a subject in need thereof according to the method of claim 11; closing the reversibly closable proximal opening, which is a proximal opening of the second lumen; and delivering nutrients and/or medicaments via the first lumen into the distal aspect of the lumen of the gastrointestinal tract of the subject.

16. The method according to claim 15, further comprising opening the proximal opening of the second lumen after completing delivery of the nutrients and/or medicaments via the first lumen into the distal aspect of the lumen of the gastrointestinal tract of the subject.

17. A method of reducing stoma inflammation in a subject receiving enteral support via an enteral feeding device, comprising positioning the enteral feeding device in a subject in need thereof according to the method of claim 11; and maintaining the reversibly closable proximal opening, which is a proximal opening of the second lumen, in an open configuration between periods of delivery of nutrients and/or medicaments via the first lumen into the distal aspect of the lumen of the gastrointestinal tract of the subject.

18. An enteral feeding device, comprising a first tube comprising a wall and a proximal end and a distal end, the first tube defining a first lumen that extends longitudinally through at least a portion of the first tube, the first tube comprising at least one distal opening capable of allowing delivery of liquids from within the first lumen; and a second tube, connected to and extending away from the first tube, comprising a proximal end and a distal end, the second tube defining a second lumen that extends longitudinally through at least a portion of the second tube and is in fluid communication with the first lumen via a reversibly closable proximal opening, the second tube comprising at least one distal opening capable of allowing delivery of liquids to the at least one distal opening of the first tube via the second lumen and the first lumen when the reversibly closable proximal opening is open, wherein the proximal end of the first tube is constructed and arranged so as the first lumen is capable of receivably engaging a reservoir, and wherein engagement of the reservoir by the first lumen reversibly closes the reversibly closeable proximal opening, which is a proximal opening of the second lumen.

19. The enteral feeding device according to claim 18, wherein any one or more of the first and second tubes comprises a plurality of distal openings.

20. The enteral feeding device according to claim 18, further comprising an expandable placement/securement balloon and a third tube, wherein the balloon comprises an interior and an exterior and is attached to an exterior surface of the first tube proximal to the connection between the first tube and the second tube, and wherein the third tube is connected to the first tube and to the balloon, the third tube comprising a proximal end and a distal end, the third tube defining a third lumen that extends longitudinally along at least a portion of the third tube, and the third tube comprising at least one distal opening capable of allowing reversible delivery of a fluid from within the third lumen into the interior of the balloon.

* * * * *